US010309359B2

(12) United States Patent
Laepple et al.

(10) Patent No.: US 10,309,359 B2
(45) Date of Patent: Jun. 4, 2019

(54) HIGH-PRESSURE FUEL PUMP

(71) Applicant: Robert Bosch GmbH, Stuttgart (DE)

(72) Inventors: Karl-Heinz Laepple, Althengstett (DE); Francesco Lucarelli, Stuttgart (DE); Dietmar Van Der Linden, Rietenau (DE)

(73) Assignee: Robert Bosch GmbH, Stuttgart (DE)

( * ) Notice: Subject to any disclaimer, the term of this patent is extended or adjusted under 35 U.S.C. 154(b) by 7 days.

(21) Appl. No.: 15/770,426

(22) PCT Filed: Oct. 5, 2016

(86) PCT No.: PCT/EP2016/073759
§ 371 (c)(1),
(2) Date: Apr. 23, 2018

(87) PCT Pub. No.: WO2017/071921
PCT Pub. Date: May 4, 2017

(65) Prior Publication Data

US 2018/0306151 A1 Oct. 25, 2018

(30) Foreign Application Priority Data

Oct. 28, 2015 (DE) ..... 10 2015 221 056

(51) Int. Cl.
*F02M 59/48* (2006.01)
*F02M 59/44* (2006.01)
(Continued)

(52) U.S. Cl.
CPC ..... *F02M 59/48* (2013.01); *F02B 77/11* (2013.01); *F02M 59/44* (2013.01);
(Continued)

(58) Field of Classification Search
CPC ..... F02M 59/48; F02M 59/44; F02M 63/00; F02M 59/466; F02M 2200/852;
(Continued)

(56) References Cited

U.S. PATENT DOCUMENTS

2012/0315159 A1* 12/2012 Fisk ..... B60R 13/0838 417/231
2016/0222960 A1* 8/2016 Inatani ..... F04B 1/0448
2018/0363609 A1* 12/2018 Lucarelli ..... F02M 59/102

FOREIGN PATENT DOCUMENTS

CN 203463213 3/2013
CN 104895719 9/2015
(Continued)

OTHER PUBLICATIONS

International Search Report for Application No. PCT/EP2016/073759 dated Jan. 3, 2017 (English Translation, 2 pages).

*Primary Examiner* — Xiao En Mo
(74) *Attorney, Agent, or Firm* — Michael Best & Friedrich LLP

(57) ABSTRACT

The invention relates to a high-pressure fuel pump (1), in particular of a common rail injection system of an internal combustion engine, having a pump cylinder head (3), having an intake valve (6) arranged in the pump cylinder head (3) in the direction of a pump cylinder axis, and a high-pressure fuel outlet (5) arranged laterally on the pump cylinder head (3), wherein a protective cap (10, 10*a*) at least partly covering the high-pressure fuel pump (1) is provided. According to the invention, a high-pressure fuel pump (1) having a protective cap (10, 10*a*) is provided, in which the protective cap (10, 10*a*) can be mounted without difficulty on an assembled high-pressure fuel pump (1). This is achieved in that a plug (8) having a lateral lead connection (9) is placed on the electrically operated intake valve (6), and the protective cap (1) is formed in two pieces and has
(Continued)

two protective cap parts (11*a*,11*b*) that can be fitted to each other, or else in that a plug (8) having a lateral lead connection (9) is placed on the electrically operated intake valve (6), and the protective cap (10*a*) is formed annularly and has a free clearance slot (19) interrupting the ring.

5 Claims, 6 Drawing Sheets

(51) Int. Cl.

| | |
|---|---|
| ***F02B 77/11*** | (2006.01) |
| ***F04B 53/00*** | (2006.01) |
| ***F04B 1/00*** | (2006.01) |
| ***F04B 53/16*** | (2006.01) |
| ***F02M 59/46*** | (2006.01) |
| ***F04B 53/22*** | (2006.01) |
| *F02M 53/00* | (2006.01) |
| *F02M 59/36* | (2006.01) |

(52) U.S. Cl.
CPC ..... *F02M 59/466* (2013.01); *F04B 1/00* (2013.01); *F04B 53/002* (2013.01); *F04B 53/16* (2013.01); *F04B 53/22* (2013.01); *F02M 53/00* (2013.01); *F02M 59/366* (2013.01); *F02M 2200/05* (2013.01); *F02M 2200/09* (2013.01); *F02M 2200/852* (2013.01); *F02M 2200/853* (2013.01); *F02M 2200/9015* (2013.01)

(58) Field of Classification Search
CPC ..... F02M 2200/9015; F02M 53/00; F02M 2200/05; F02M 2200/09; F02M 59/366; F02M 2200/853; F04B 53/22; F04B 1/00; F04B 53/16; F04B 53/002; F02B 77/11; F02B 77/13
See application file for complete search history.

(56) References Cited

FOREIGN PATENT DOCUMENTS

| | | |
|---|---|---|
| DE | 102013211176 | 12/2014 |
| JP | 2001263196 | 9/2001 |
| JP | 2011208538 | 10/2011 |
| WO | 2011106244 | 9/2011 |

* cited by examiner

HIGH-PRESSURE FUEL PUMP

BACKGROUND OF THE INVENTION

The invention relates to a high-pressure fuel pump, in particular of a common-rail injection system of an internal combustion engine, having a pump cylinder head, having a suction valve arranged in the direction of the pump cylinder axis in the pump cylinder head, and having a high-pressure fuel outlet arranged laterally on the pump cylinder head, wherein a protective cap is provided which at least partially covers the high-pressure fuel pump.

A high-pressure fuel pump of said type is known from DE 10 2013 211 176 A1. Said high-pressure fuel pump of a common-rail injection system of an internal combustion engine has a pump cylinder head which is formed in one piece with a pump cylinder. In the pump cylinder head, in the direction of the pump cylinder axis, there is arranged a suction valve via which fuel can be introduced into a pump working chamber. Furthermore, a high-pressure fuel outlet with a check valve is arranged laterally on the pump cylinder head. On the pump cylinder head, there is mounted a protective cap which surrounds the pump cylinder head and which has a continuous headwall in particular in the region of the suction valve.

The invention is based on the object of providing a high-pressure fuel pump having a protective cap, in the case of which the protective cap can be mounted on an assembled high-pressure fuel pump.

SUMMARY OF THE INVENTION

Said object is achieved in that an electrical plug with a lateral line connector is mounted onto the electrically actuated suction valve, and in that the protective cap, in a first embodiment, is formed in two parts and has two protective cap parts. The object is likewise achieved in that an electrical plug with a lateral line connector is mounted onto the electrically actuated suction valve, and in that the protective cap, in a second embodiment, is of ring-shaped form and has a clearance slot which interrupts the ring-shaped protective cap. The protective cap formed in this way can, in both embodiments, be mounted on an assembled high-pressure fuel pump without the need for the electrical plug of the electrical connector line for the actuation of the electrically actuated valve having to be removed. In this way, the reliability of the installation of the high-pressure fuel pump is increased through the avoidance of a situation in which the electrical plug has to be dismounted for the purposes of mounting the protective cap and is possibly subsequently mounted again incorrectly. Here, the protective cap that can be mounted in this way furthermore performs further tasks. The pump cylinder head of the high-pressure fuel pump is produced from a metallic material, preferably as a cast part, and is mechanically blank on its surface pointing toward the surroundings. In particular, the pump cylinder head is not covered by a corrosion prevention means, for example in the form of a lacquer. The pump cylinder head can therefore corrode over the course of time without impairing the function of the high-pressure fuel pump, which constitutes an undesired visual appearance. Since the pump cylinder head is however covered with the protective cap formed according to the invention, this negative appearance is avoided. Furthermore, the protective cap constitutes a noise shield, which is effective in suppressing noise emissions originating from the high-pressure fuel pump. Finally, the protective cap constitutes a thermal guard for example for preventing the high-pressure fuel pump, that has warmed up during operation, from being touched. Since the electrical plug is manufactured from a non-metallic material, in particular from a plastics material, said electrical plug can perform the functions discussed above in addition to the protective cap, such that the protective cap designed according to the invention can have an aperture region in the region of the electrical plug without restricting functionality. In other words, said aperture region thus in particular forms a recess around the electrical plug.

The protective cap formed in two parts may be composed of two entirely independent protective cap parts, which are connected to one another during the mounting process. For this purpose, the two protective cap parts preferably each have a detent hook which engages into a corresponding detent groove of the second protective cap part. The two protective cap parts may however also be connected to one another at one side by means of a hinge, wherein, during the mounting process, the two protective cap parts are pivoted about the pump cylinder head and are connected to one another on the opposite side in relation to the hinge by means of the detent hook that engages into the detent groove. Here, the parting plane of the two protective cap parts preferably lies transversely with respect to the axis of the high-pressure fuel outlet. Furthermore, in the region of the high-pressure outlet, one protective cap part has a downwardly open recess, whereas the second protective cap part is formed without a recess. The protective cap thus formed from two protective cap parts can be mounted very easily.

The hinge that connects the two protective cap parts is advantageously designed as a film hinge. That is to say, the two protective cap parts are integrally connected by means of the film hinge. The two parts of the protective cap accordingly need not imperatively be two entirely independent protective cap parts. During the mounting process, the two protective cap parts connected by means of the film hinge are placed around the pump cylinder head so as to enclose the latter in ring-shaped fashion. At their ends respectively situated opposite the film hinge, the two protective cap parts are subsequently connected. The connection may in turn be realized by means of a detent or snap-action connection. No auxiliary tool is required for this purpose.

The film hinge preferably permits pivoting of the two protective cap parts about a pivot axis which runs parallel to the pump cylinder axis. In this case, the two protective cap parts may be formed as half-shells which are pivotable relative to one another and which, after being placed on and connected, form a substantially ring-shaped protective cap.

In a further embodiment of the invention, it is preferable for both protective cap parts to have in each case one domed projection which extends in the direction of the electrical plug. When the protective cap has been mounted, said domed projection forms a ring which surrounds a sleeve nut by means of which the suction valve is fastened to the pump cylinder head. Here, the domed projection may be formed so as to directly adjoin the electrical plug, so as to realize a visually unitary appearance of said components. The protective cap with the protective cap parts and the domed projection are preferably manufactured from a plastics material, and can thus be easily produced in a corresponding injection mold. Here, the abovementioned hinge may easily be designed as a connecting lug of the two covering parts, in particular as a film hinge. Finally, by means of this embodiment, a possible ingress of water into the suction valve is reduced in that a partition with respect to the lower region of the sleeve nut can be realized by means of the protective cap.

The protective cap of ring-shaped form with the clearance slot which interrupts the ring-shaped protective cap is fitted over the electrical plug with the line connector, and the clearance slot is thus aligned relative to the lateral high-pressure fuel outlet such that the latter is arranged in the clearance slot when the protective cap has been mounted. The protective cap thus formed can be mounted easily in the case of an electrical plug with a lateral or upwardly directed line connector, wherein the lateral cable exit of the electrical plug may be pivoted through any desired angle with respect to the lateral high-pressure fuel outlet. In all possible embodiments, the protective cap is fitted with the clearance slot firstly over the line connector (with the onward-leading lines) of the electrical plug, and the protective cap is then pivoted such that the clearance slot is aligned in the direction of the lateral high-pressure fuel outlet. The protective cap is then pushed downward onto the pump cylinder head.

In a refinement of the invention, the protective cap has clamping lugs which are adjacent to the clearance slot and which serve for interacting with a clamping ring. After the mounting of the protective cap onto the pump cylinder head, the clamping ring is mounted over the high-pressure fuel outlet and is pushed over the two clamping lugs. The protective cap is thus connected in the region of the clearance slot so as to form a continuous component. Here, the clamping ring preferably has a covering lug for the clearance slot, such that a continuous top wall is formed after the mounting process has been performed.

In a further embodiment of the invention, the protective cap has a domed projection which extends in the direction of the electrical plug and which has a slot. This embodiment ensures that the above-described sleeve nut for the fastening of the suction valve is also encased. Here, the domed projection and the protective cap may be formed as separate components, which are mounted one after the other.

BRIEF DESCRIPTION OF THE DRAWINGS

Further advantageous embodiments of the invention emerge from the description of the drawings, in which exemplary embodiments of the invention illustrated in the figures are described in more detail.

In the figures.

DETAILED DESCRIPTION

Figure 1:
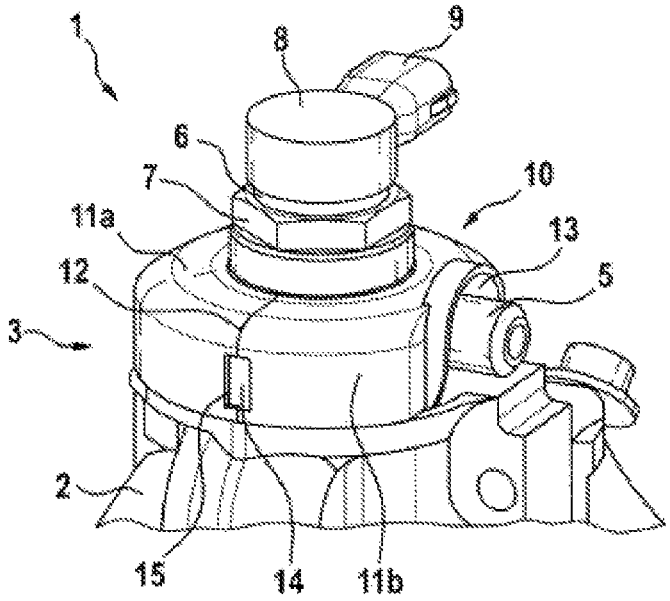
FIG. 1 shows a perspective partial view of a high-pressure fuel pump with a mounted protective cap which is composed of two protective cap parts.
Figure 2:
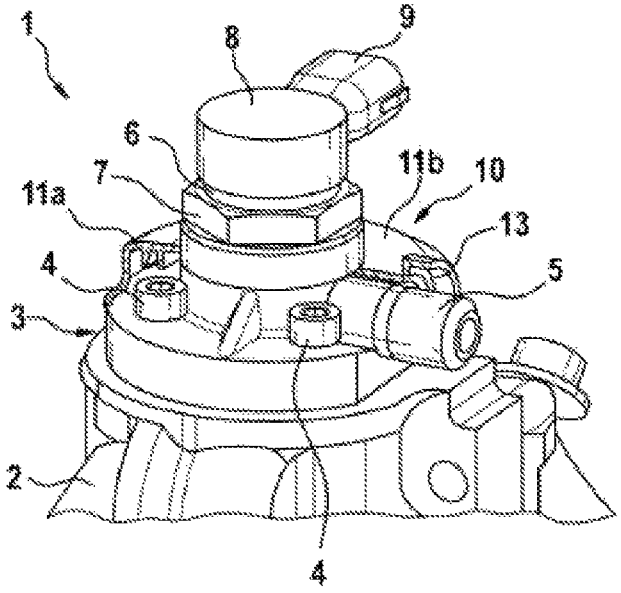
FIG. 2 shows a further perspective partial view of a high-pressure fuel pump with a mounted protective cap.

FIGS. 1 and 2 show the upper part of a high-pressure fuel pump 1 having a pump housing 2 on which a pump cylinder head 3 (see in particular FIG. 2) is mounted. By contrast to FIG. 1, FIG. 2 shows a protective cap 10 that has been sectioned in the plane of the high-pressure fuel outlet 5, in order to provide a better illustration of the pump cylinder head 3. The pump cylinder head 3 is fastened to the pump housing 2 by means of four screws 4, and has a lateral high-pressure fuel outlet 5. A high-pressure line is fastenable to the high-pressure fuel outlet 5, through which high-pressure line the fuel delivered by the high-pressure fuel pump 1 is conducted into a high-pressure accumulator. The high-pressure fuel pump 1 is preferably part of a common-rail injection system which is installed on an internal combustion engine. Here, the high-pressure fuel pump 1 is fed with fuel from a low-pressure system through a feed arranged in the pump housing 2 and in the pump cylinder head 3, wherein the metered fuel quantity is determined by a suction valve 6 formed as an electrically actuated valve. The suction valve 6 is fastened to the pump cylinder head 3 by means of a sleeve nut 7. The suction valve 6 connects the feed to a pump working chamber in the pump cylinder head 3 in order to define the fuel delivered by the high-pressure fuel pump 1. An electrical plug 8 with a lateral line connector 9 is mounted onto the suction valve 6. The line connector 9 is preferably formed in one piece with an onward-leading signal line (not illustrated) which is connected to a control unit for actuating the suction valve. In the exemplary embodiment illustrated, the electrical plug 8 is oriented with the lateral line connector 9 rotated relative to the high-pressure fuel outlet 5 through approximately 90°.

Onto the pump cylinder head 3, which is produced from a metallic material, for example by casting, and which is metallically blank on its surface pointing toward the surroundings, there is mounted a protective cap 10 which is composed of two protective cap parts 11*a*, 11*b*. The parting plane 12 that defines the two protective cap parts 11*a*, 11*b* runs transversely with respect to, in particular, the high-pressure fuel outlet 5. Accordingly, the protective cap part 11*b* has a recess 13 which surrounds the high-pressure fuel outlet 5 and which is open toward the pump housing 2. The two protective cap parts 11*a*, 11*b* have in each case one detent hook 14, which can be engaged into an oppositely situated detent groove 15 of the other protective cap part 11*b*, 11*a*. Alternatively, at one side, instead of a detent hook 14 and a detent groove 15, the two protective cap parts 11*a*, 11*b* may also have a hinge which connects the two protective cap parts 11*a*, 11*b*. The protective cap parts 11*a*, 11*b* are preferably produced from a plastics material, such that the hinge may be formed as an elastic lug which connects the two protective cap parts 11*a*, 11*b*.

Figure 3:
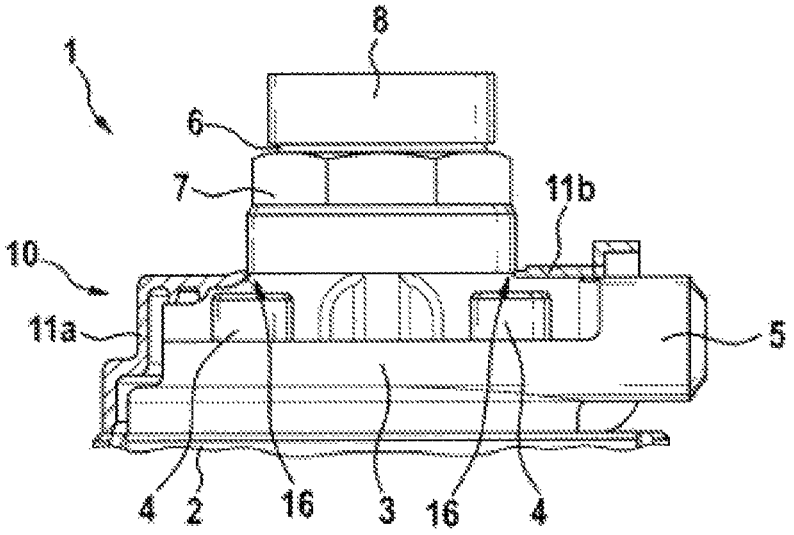
FIG. 3 shows a side view of a high-pressure fuel pump with, in section, a protective cap.

To ensure a secure seat of the protective cap 10 on the pump cylinder head 3, the two protective cap parts 11*a*, 11*b* have clamping lugs 16 which, as can be seen from FIG. 3, project under the sleeve nut 7.

Figure 4:
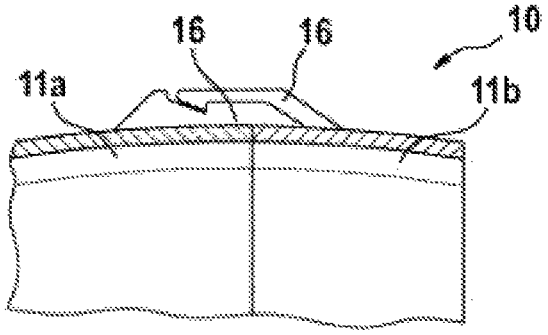
FIG. 4 shows a detailed view of a protective cap.

FIG. 4 shows a further embodiment of the clamping lugs 16 of the two protective cap parts 11*a*, 11*b*, which are additionally hooked one into the other.

Figure 5:
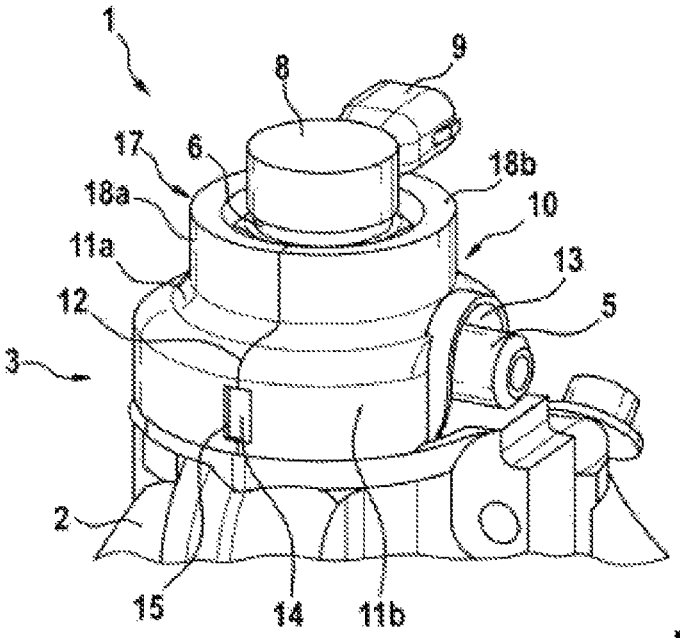
FIG. 5 shows a perspective partial view of a high-pressure fuel pump with a protective cap which has a domed projection.

FIG. 5 shows a protective cap 10 analogous to the embodiments described in the preceding figures, wherein, in the embodiment illustrated in FIG. 5, the protective cap 10 has a domed projection 17 which surrounds the sleeve nut 7 and which in turn is composed of two domed projection parts 18*a*, 18*b*, which are in each case formed in one piece with the protective cap parts 11*a*, 11*b*. Ultimately, by means of this embodiment, a possible ingress of water into the suction valve 6 is reduced in that a partition with respect to the lower region of the sleeve nut 7 is realized by means of the protective cap 10 together with the domed projection 17.

Figure 6:
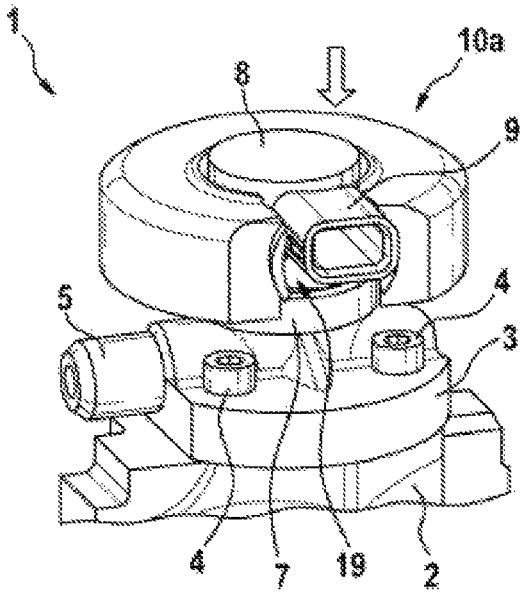
FIG. 6 shows a perspective partial view of a high-pressure fuel pump with a mounted protective cap in a further embodiment.
Figure 7:
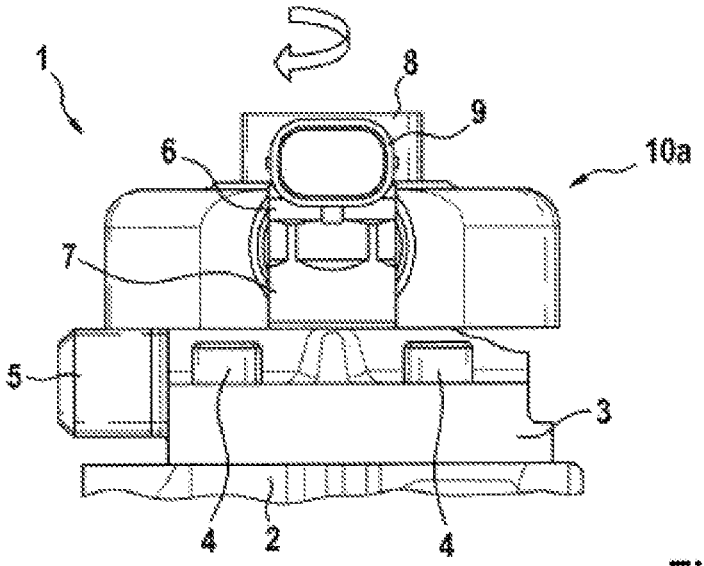
FIG. 7 shows a further partial view of a high-pressure fuel pump with a protective cap analogous to FIG. 6.
Figure 8:
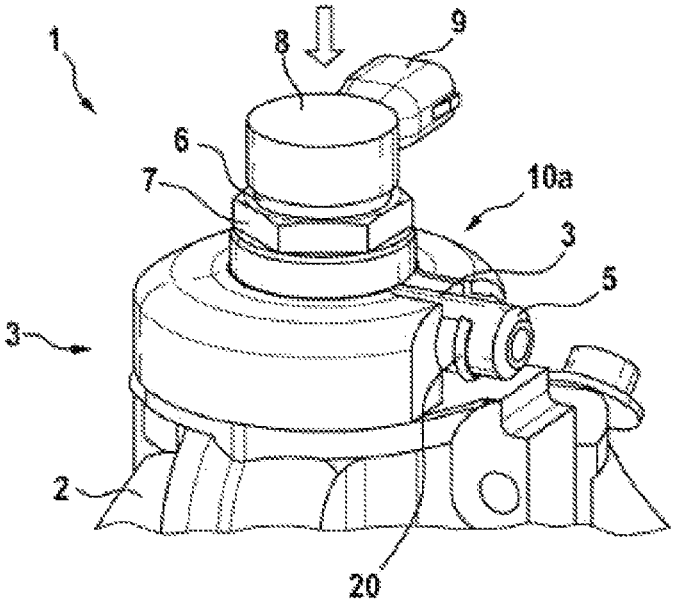
FIG. 8 shows a further perspective partial view of a high-pressure fuel pump with a protective cap analogous to FIG. 6.
Figure 9:
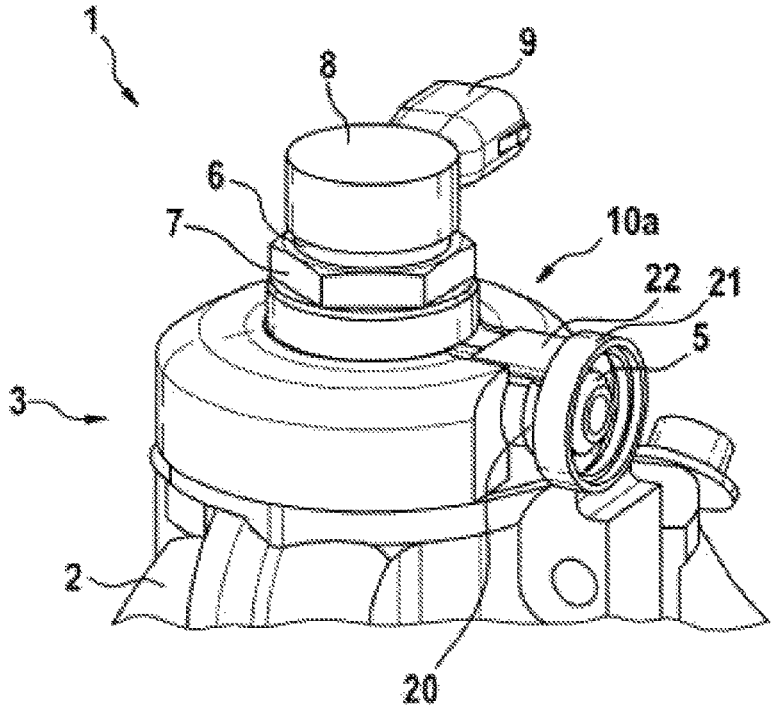
FIG. 9 shows a further perspective partial view of a high-pressure fuel pump with a mounted protective cap analogous to FIG. 6, and FIGS. 10*a* and 10*b* are plan views of a two-part protective cap with film hinge a) open and b) closed.

In the embodiments of the protective cap 10*a* illustrated in FIGS. 6 to 9, said protective cap is of ring-shaped form and has a clearance slot 19 which interrupts the ring. The protective cap 10*a* is mounted by being fitted, as illustrated in FIG. 6, over the electrical plug 8 with the lateral line connector 9, then, when situated below the lateral line connector 9, being rotated as shown in FIG. 7 such that the clearance slot 19 lies above the lateral high-pressure fuel outlet 5, and then being fitted over the pump cylinder head 3 until it makes contact with the pump housing 2, as shown in FIG. 8. The protective cap 10*a* has clamping lugs 20 arranged to both sides of the clearance slot 19. A clamping ring 21 can be pushed onto said clamping lugs 20, as illustrated in FIG. 9. The clamping ring has a covering lug 22 which, when the clamping ring 21 has been mounted, covers the clearance slot 19 at the top wall of the protective cap 10*a*.

The protective cap 10*a* may also have a domed projection (not illustrated) which has an elongated slot above the clearance slot. The domed projection is preferably formed from an elastic plastic, such that it can be rotated under the line connector 9 in a reversibly deformable manner. In this embodiment, the clamping ring may be designed such that a widened covering lug also covers the clearance slot of the domed projection. Alternatively, the domed projection may also be formed separately from the protective cap 10*a* and mounted after the protective cap 10*a* has been mounted.

FIG. 10 shows a unipartite embodiment of a two-part protective cap 10. This is because, in this case, the two protective cap parts 11*a* and 11*b* are connected by means of a film hinge 23. The pivot axis of the film hinge 23 runs parallel to the pump cylinder longitudinal axis, such that two protective cap parts 11*a* and 11*b* in the form of two half-shells are formed, which are pivotable relative to one another. The parting plane 12 running through the pivot axis is, with regard to its angular position, arranged offset with respect to the center of the recess 13 by 90°. The recess 13, which serves for receiving the high-pressure fuel outlet 5, is in the present case formed in the protective cap part 11*b*.

Figure 10A:
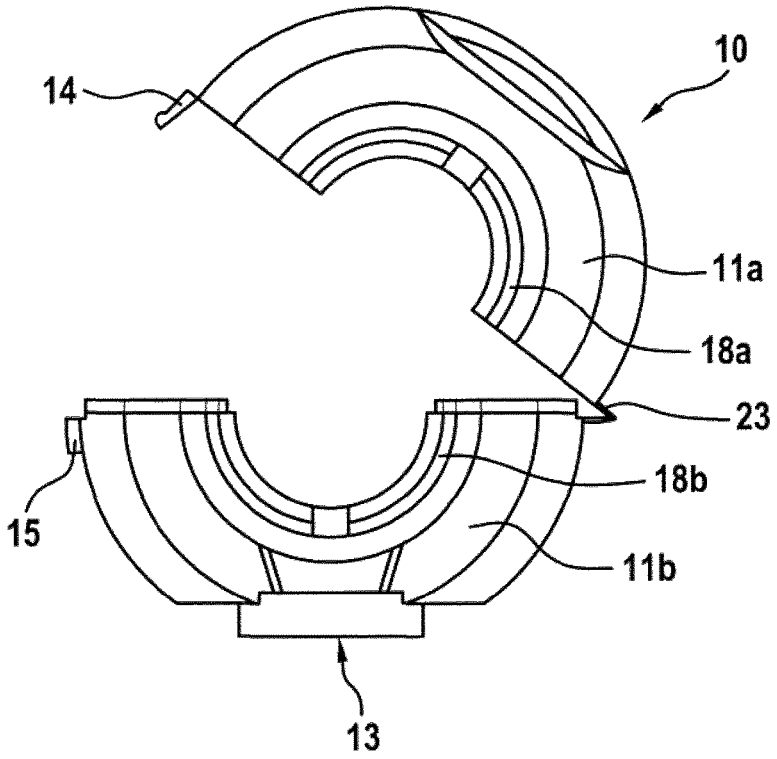
Figure 10B:
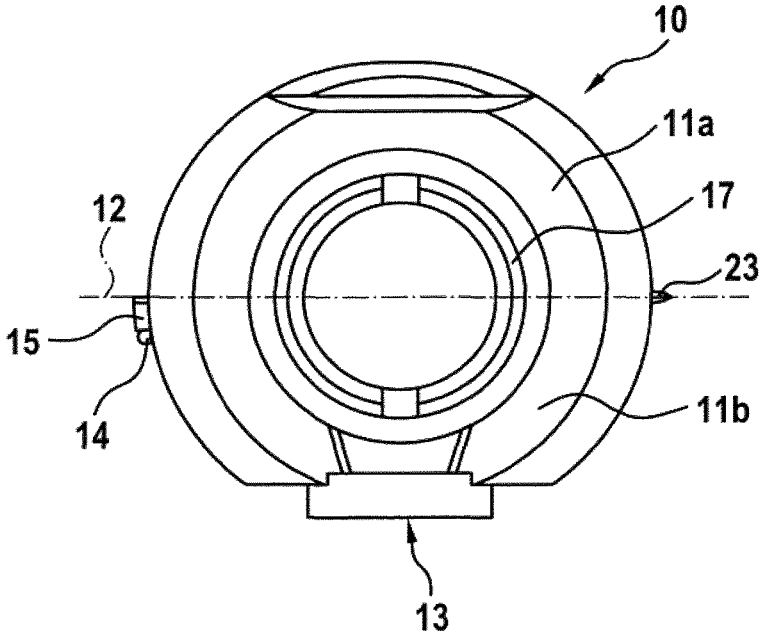

During the mounting of the protective cap 10, the two protective cap parts 11*a* and 11*b* are pivoted relative to one another such that an opening is formed on the side situated opposite the film hinge 23 (see FIG. 10*a*). The opening enables the protective cap 10 to be placed onto the pump cylinder head 3 such that the high-pressure fuel outlet 5 comes to lie within the recess 13 of the protective cap part 11*b*. The other protective cap part 11*a* is subsequently pivoted such that the two protective cap parts 11*a* and 11*b* enclose the pump cylinder head 3 in ring-shaped fashion. Here, a detent hook 14 formed on the protective cap part 11*a* engages into a detent groove 15 formed on the protective cap part 11*b* (see FIG. 10*b*).

The two protective cap parts 11*a* and 11*b* illustrated in FIG. 10 together form a domed projection 17. For this purpose, they have in each case one domed projection part 18*a* and 18*b* respectively. If no domed projection 17 is required, the two protective cap parts 11*a* and 11*b* may also be formed without domed projection parts 18*a* and 18*b*—analogously to the embodiment illustrated in FIG. 1.

The invention claimed is:

1. A high-pressure fuel pump (1), comprising
a pump cylinder head (3),
a suction valve (6) arranged in a direction of a pump cylinder axis in the pump cylinder head (3),
a high-pressure fuel outlet (5) arranged laterally on the pump cylinder head (3), and
a ring-shaped protective cap (10*a*) which at least partially covers the high-pressure fuel pump (1),
wherein an electrical plug (8) with a lateral line connector (9) is mounted onto the electrically actuated suction valve (6), and wherein the protective cap (10*a*) has a clearance slot (19) which interrupts the ring-shaped protective cap (10*a*).

2. The high-pressure fuel pump (1) as claimed in claim 1, characterized in that the clearance slot (19) has a contour which surrounds the high-pressure fuel outlet (5).

3. The high-pressure fuel pump (1) as claimed in claim 1, characterized in that the protective cap (10*a*) has clamping lugs (20) which adjoin the clearance slot (19) and which interact with a clamping ring (21).

4. The high-pressure fuel pump (1) as claimed in claim 3, characterized in that the clamping ring (21) has a covering lug (22) for at least partially covering the clearance slot (19).

5. The high-pressure fuel pump (1) as claimed in claim 1, characterized in that the protective cap (10*a*) has a domed projection which extends in a direction of the electrical plug (8).

* * * * *